US006846371B2

(12) United States Patent
Miyata et al.

(10) Patent No.: US 6,846,371 B2
(45) Date of Patent: Jan. 25, 2005

(54) METHOD FOR MAKING HIGH-STRENGTH HIGH-TOUGHNESS MARTENSITIC STAINLESS STEEL SEAMLESS PIPE

(75) Inventors: Yukio Miyata, Handa (JP); Mitsuo Kimura, Handa (JP); Takaaki Toyooka, Handa (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 10/226,916

(22) Filed: Aug. 23, 2002

(65) Prior Publication Data

US 2003/0066580 A1 Apr. 10, 2003

(30) Foreign Application Priority Data

Aug. 29, 2001 (JP) ..... 2001-259889
Apr. 30, 2002 (JP) ..... 2002-128533

(51) Int. Cl.[7] ..... C21D 8/10
(52) U.S. Cl. ..... 148/593
(58) Field of Search ..... 148/590, 592, 148/593

(56) References Cited

U.S. PATENT DOCUMENTS 6,136,109 A 10/2000 Miyata et al.

FOREIGN PATENT DOCUMENTS

| | | |
|---|---|---|
| EP | 0 178 334 | 4/1986 |
| JP | 11-23028 | 5/1989 |
| JP | 6-306466 | 11/1994 |
| JP | 6-330170 | 11/1994 |
| JP | 7-150251 | 6/1995 |

*Primary Examiner*—Deborah Yee
(74) *Attorney, Agent, or Firm*—Piper Rudnick LLP

(57) ABSTRACT

A method of producing a high-strength high-toughness martensitic stainless steel seamless pipe which includes heating a martensitic stainless steel raw material to an austenitic range and subjecting the raw material to piercing and elongating to form an original pipe. The original pipe is cooled to form a structure substantially composed of martensite in the original pipe. The original pipe is reheated to a temperature in the dual-phase range between the $A_{c1}$ transformation point and the $A_{c3}$ transformation point, and is subjected to finishing rolling at an initial rolling temperature T (° C.) between the $A_{c1}$ transformation point and the $A_{c3}$ transformation point. The original pipe is then cooled to form a processed pipe. The processed pipe is tempered at a temperature below the $A_{c1}$ transformation point. The reduction in area R in the finishing rolling step may be in the range of 10% to 90%, and the initial rolling temperature T and the reduction in area R may satisfy the relationship $800 \leqq T - 0.625R \leqq 850$.

13 Claims, 2 Drawing Sheets

| REGION | SYMBOL | ABSORPTION ENERGY PER UNIT AREA IN C DIRECTION ($J/cm^2$) | ABSORPTION ENERGY PER UNIT AREA IN L DIRECTION ($J/cm^2$) | C/L |
|---|---|---|---|---|
| A | ◆ | <90 | ≧180 | <0.80 |
| B | ▲ | 90 −180 | ≧180 | <0.80 |
| C | ○ | ≧180 | ≧180 | ≧0.80 |
| D | △ | 90 −180 | 90 −180 | ≧0.80 |
| E | ◇ | <90 | <90 | ≧0.80 |

METHOD FOR MAKING HIGH-STRENGTH HIGH-TOUGHNESS MARTENSITIC STAINLESS STEEL SEAMLESS PIPE

BACKGROUND

1. Field of the Invention

This invention relates to a method for making a martensitic stainless steel seamless pipe. The seamless pipe has high corrosion resistance and is suitable for oil country tubular goods (OCTGs). In particular, the invention relates to improvements in toughness and a decrease in anisotropy of toughness.

2. Description of the Related Art

In consideration of the advance in crude oil prices and anticipated depletion of oil resources in the near future, deep stratum oil fields and highly corrosive sour gas fields are being developed all over the world.

These oil and gas fields generally spread out at very deep layers and in severely corrosive environments at high temperatures containing $CO_2$, $Cl^-$ ions and the like. Thus, OCTGs used in these fields must have high toughness and high corrosion resistance. In general, under severe corrosive environments containing such $CO_2$, $Cl^-$ ions and the like, martensitic stainless steel seamless pipes with high $CO_2$ corrosion resistance containing 13% chromium are primarily used.

Martensitic stainless steel seamless pipes are generally produced by the following process: A raw steel material is heated to a temperature capable of piercing, and subjected to piercing using a piercing mill and elongating using a mandrel mill or plug mill to form an original pipe. The original pipe is reheated to an austenitic temperature range and subjected to finishing rolling using a hot stretch reducing mill or a sizing mill. After air-cooling, the composition of the seamless pipe comprises martensite. The seamless pipe is subjected to quenching from the austenitic temperature range and tempering at a temperature below the $A_{C1}$ transformation point if higher strength and higher toughness are required.

Oil well pipes used in deteriorating well environments must have higher mechanical properties, such as higher toughness at low temperatures and higher resistance to sulfide stress cracking.

In order to satisfy such requirements, for example, Japanese Unexamined Patent Application Publication No. 1-123025 discloses a method for making a martensitic stainless steel seamless pipe. This method includes the steps of piercing and rolling a martensitic stainless steel slab at a temperature of 1,050° C. to 1,250° C.; cooling the rolled pipe at a cooling rate of 30° C./min to at least 500° C. and further cooling the pipe to a temperature below the martensite transformation temperature to form a steel structure containing at least 80% of martensite; reheating the pipe to a temperature between ($A_{c1}$ transformation point −200° C.) and $A_{c1}$ transformation point and finishing-rolling the pipe at a reduction in area of at least 5%; maintaining the pipe at the final finishing-rolling temperature or reheating the pipe to a temperature below the $A_{c1}$ transformation point immediately after the finishing rolling step, and then cooling the pipe by spontaneous or forced air cooling. Alternatively, after the step of forming the martensitic structure, this method may include the steps of reheating the pipe to a temperature between the ($A_{c1}$ transformation point −200° C.) and the $A_{c1}$ transformation point, finishing-rolling the pipe at a reduction in area of at least 5%, and then cooling the pipe by spontaneous or forced air cooling; reheating the pipe to a temperature below the $A_{c1}$ transformation point immediately after the finishing rolling step, and then cooling the pipe by spontaneous or forced air cooling.

However, the seamless pipe produced by this method has the following problem: Since the pipe is rolled at a non-recrystallization temperature range, the structure is elongated in the rolling direction. As a result, the toughness and corrosion resistance of the seamless pipe are high in the rolling direction, but low in the circumferential direction perpendicular to the rolling direction. In other words, the seamless pipe exhibits noticeable anisotropy in mechanical properties.

SUMMARY OF THE INVENTION

It would, therefore, be advantageous to provide a method for making a martensitic stainless steel seamless pipe having high strength, high toughness, and low anisotropy of mechanical properties, at low cost. In the invention, "high strength" means a yield strength YS of the pipe of about 551 MPa or more, and "high toughness" means an absorbed energy per unit area at −40° C. by the Charpy impact test (hereinafter referred to as "$E_{-40}$") is about 90 J/cm$^2$ or more.

We intensively investigated the effects of finishing rolling conditions on toughness, and discovered that a seamless pipe having a fine martensitic structure with low anisotropy was obtained by reheating an original pipe that had been preliminarily treated so as to have a martensitic structure to a dual-phase temperature range at which both a ferritic ($\alpha$) phase and an austenitic ($\gamma$) phase; finishing-rolling the pipe at a specific initial rolling temperature and a specific reduction in area; cooling the pipe; and tempering the pipe.

Hence, this invention is direct to a method for making a high-strength high-toughness martensitic stainless steel seamless pipe including an original pipe production step of heating a martensitic stainless steel raw material to an austenitic range, piercing and elongating the raw material to form an original pipe, cooling the original pipe to form a structure substantially composed of martensite in the original pipe; a finishing rolling step of reheating the original pipe to a temperature in the dual-phase range between the $A_{c1}$ transformation point and the $A_{c3}$ transformation point, finishing-rolling the original pipe at an initial rolling temperature T (° C.) between the $A_{c1}$ transformation point and the $A_{c3}$ transformation point, cooling the original pipe to form a processed pipe having a predetermined size; and tempering the processed pipe at a temperature below the $A_{c1}$ transformation point.

Preferably, the reduction in area R in the finishing rolling step is in the range of about 10% to about 90%, and the initial rolling temperature T and the reduction in area R satisfies the relationship: $800 \leqq T-0.625R \leqq 850$.

DETAILED DESCRIPTION

Figure 1:
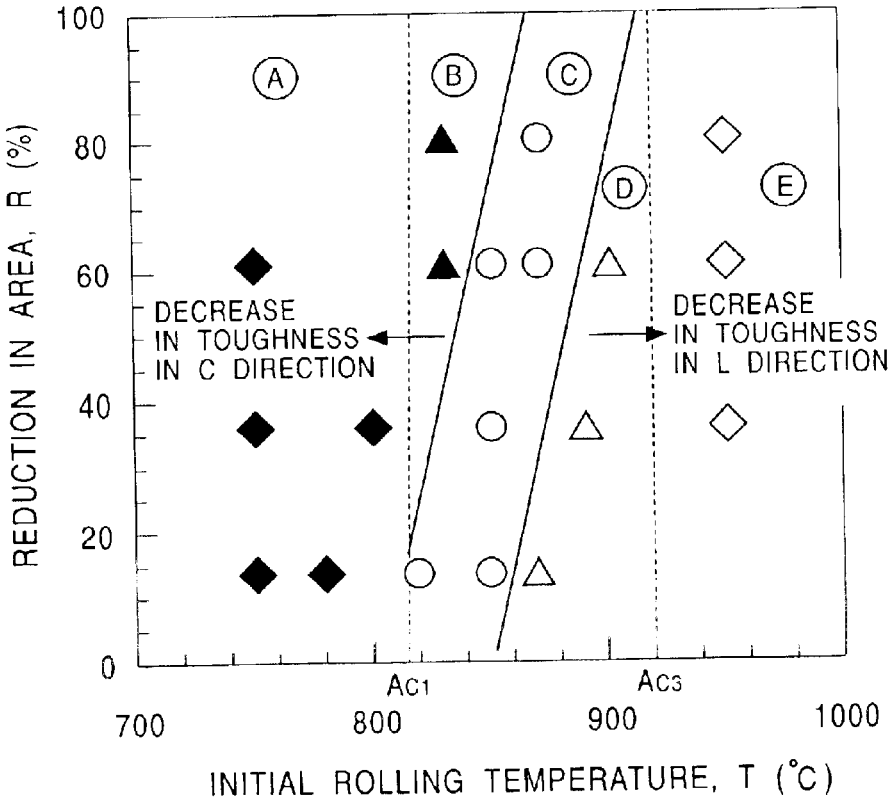
FIG. 1 is a graph showing the effects of the reduction in area R and the initial rolling temperature T in finishing rolling on the toughness of a martensitic stainless steel seamless pipe.

Any known martensitic stainless steel can be used in the invention as a raw material for a martensitic stainless steel seamless pipe. A preferable composition of the martensitic stainless steel is as follows: about 0.005% by weight (hereinafter merely %) to about 0.30% C, about 0.10% to about 1.00% Si, about 0.05% to about 2.00% Mn, about 0.03% or less of P, about 0.005% or less of S, about 10.0% to about 15.0% Cr, about 0.001% to about 0.05% Al; and the balance Fe and incidental impurities. The composition may further contain at least one element of about 7.0% or less of Ni, about 3.0% or less of Mo, and about 3.0% or less of Cu; at least one element of about 0.2% or less of Nb, about 0.2% or less of V, about 0.3% or less of Ti, about 0.2% or less of Zr, about 0.0005% to about 0.01% B, and about 0.07% or less of N; and/or at least one element of about 0.0005% to about 0.01% Ca and about 0.0005% to about 0.01% REM (rare earth metals).

The reasons for the limitation of the composition will now be described.

C: About 0.005% to About 0.30%

Carbon (C) is an essential element for ensuring desired strength of the martensitic stainless steel seamless pipe. The desired strength is achieved at a C content of at least about 0.005%. However, a C content exceeding about 0.30% causes an increase in formation of course carbide grains that decrease toughness and corrosion resistance. Thus, the upper limit of the C content is preferably about 0.30% in the invention and more preferably about 0.22% to achieve higher corrosion resistance.

Si: About 0.10% to About 1.00%

Silicon (Si) is an essential element that functions as a deoxidizing agent in the steel making process. The deoxidizing effect is noticeable at a Si content of at least about 0.10%. However, a Si content exceeding about 1.00% decreases toughness and hot workability. Thus, the upper limit of the Si content is preferably about 1.00%. More preferably, the Si content is in the range of about 0.10% to about 0.50%.

Mn: About 0.05% to About 2.00%

Manganese (Mn) is an essential element that ensures strength of the martensitic stainless steel seamless pipe. The desired strength is achieved at an Mn content of at least about 0.05%. However, an Mn content exceeding about 2.00% decreases toughness. Thus, the C content is preferably in the range of about 0.05% to about 2.00% and more preferably about 0.30% to about 1.60%.

P: About 0.03% or Less

Phosphorus (P) is an element that causes a decrease in corrosion resistance, sulfide stress cracking resistance, and hot workability; the P content is preferably as low as possible. However, an extreme reduction in P content leads to a significant increase in process costs. Thus, the P content is about 0.03% or less in the invention in view of the balance between production costs and mechanical properties, i.e., corrosion resistance and sulfide stress cracking resistance.

S: About 0.005% or Less

Sulfur (S) is an element that causes a noticeable decrease in hot workability. The P content is preferably as low as possible for improving pipe productivity and improving toughness and stress corrosion cracking resistance. However, an extreme reduction in S content leads to a significant increase in process costs. Thus, the S content is about 0.010% or less and more preferably about 0.005% or less in the invention in view of pipe production by a general process.

Cr: About 10.0% to About 15.0%

Chromium (Cr) is a primary element that ensures high corrosion resistance and stress corrosion cracking resistance of the martensitic stainless steel seamless pipe. The desired corrosion resistance is achieved at a Cr content of at least about 10.0%. However, a Cr content exceeding about 15.0% causes deterioration of hot workability. Thus, the Cr content is preferably in the range of about 10.0% to about 15.0%.

Al: About 0.001% to About 0.05%

Aluminum (Al) is an element that functions as a strong deoxidizing agent in the steel making process. The deoxidizing effect is noticeable at an Al content of at least about 0.001%. However, an Al content exceeding about 0.05% leads to an increase in oxide inclusions, which decrease toughness. Thus, the upper limit of the Al content is about 0.05%.

The composition may further contain at least one element of Ni, Mo, and Cu; at least one element of Nb, V, Ti, Zr, B, and N; and/or at least one element of Ca and REM (rare earth metals).

At Least One Element of About 7.0% or Less of Ni, About 3.0% or Less of Mo and About 3.0% or Less of Cu Ni, Mo, and Cu improve corrosion resistance of the pipe and may be added if necessary.

Ni significantly improves strength and toughness of the pipe, in addition to the corrosion resistance. These effects are noticeable at a Ni content of about 1.0% or more. However, these effects are not comparable with the Ni content if the Ni content exceeds about 7.0%.

Mo increases corrosion resistance and particularly pitting corrosion resistance. This effect is noticeable at a Mo content of about 0.1% or less. However, if the Mo content exceeds about 3.0% leads to a decrease in corrosion resistance, stress corrosion cracking resistance, and hot workability due to the formation of γ-ferrite.

Cu contributes to the formation of a stiff protective film, which increases corrosion resistance. This effect is noticeable at a Cu content of about 0.1% or more. However, a Cu content exceeding about 3.0% causes a decrease in hot workability.

At Least One Element of About 0.2% or Less of Nb, About 0.2% or Less of V, About 0.3% or Less of Ti, About 0.2% or Less of Zr, About 0.0005% to About 0.01% B, and About 0.07% or Less of N Nb, V, Ti, Zr, B, and N improve mechanical strength such as toughness and may be added to the raw material, if necessary. However, if the raw material contains not less than about 0.2% Nb, not less than about 0.2% V, not less than about 0.3% Ti, not less than about 0.2% Zr, not less than about 0.01% B, or not less than about 0.07% N, the toughness and corrosion resistance decrease.

At Least One Element of About 0.0005% to About 0.01% Ca and About 0.0005% to About 0.01% REM (Rare Earth Metals)

Ca and REM contribute to spheroidization of inclusions. Preferably, the Ca content is at least about 0.0005% or the REM content is at least about 0.0005% for the spheroidization. However, a Ca content exceeding about 0.01% or an REM content exceeding about 0.01% decreases toughness and corrosion resistance.

The balance of the composition is composed of Fe and incidental impurities.

A martensitic stainless steel molten metal having the above composition is prepared in the invention by a known process using a converter or the like. Preferably, the molten metal is cast into slabs by a continuous casting process, and the slabs are rolled to form billets (raw materials for making original pipes). Alternatively, the molten metal is preferably cast into billets directly by a continuous casting process.

Figure 2:
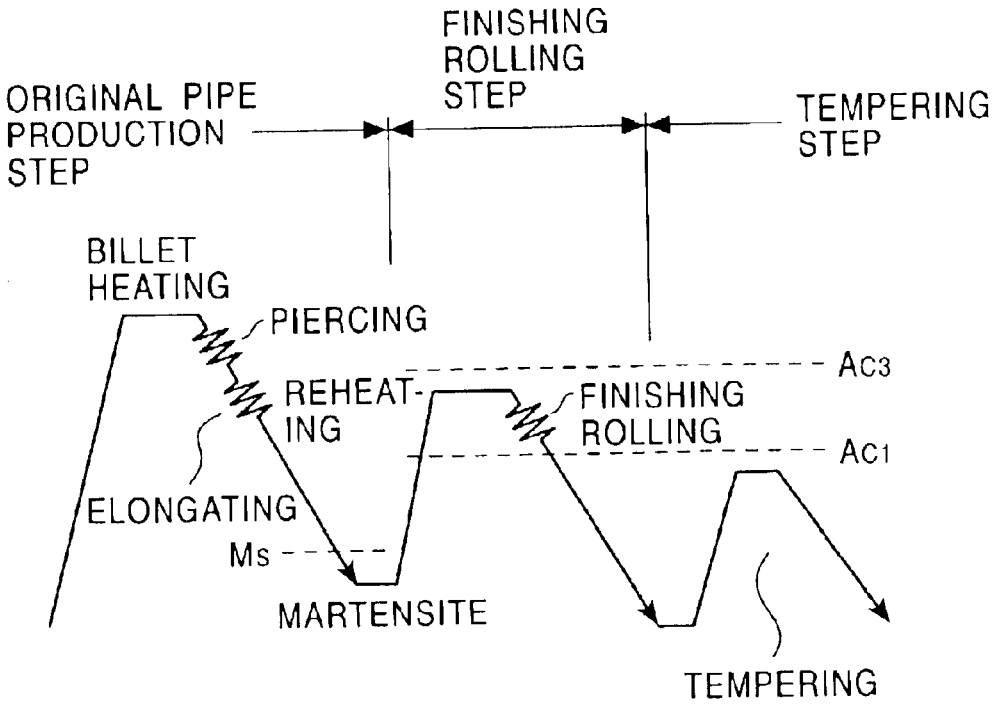
FIG. 2 is a schematic diagram showing a process for making the martensitic stainless steel seamless pipe in accordance with aspects of the invention.

FIG. 2 shows outline of the production process according to selected aspects of the invention. A billet of the martensitic stainless steel having the above composition is heated to an austenitic temperature range and subjected to piercing and elongation to form an original pipe (original pipe production step).

Preferably, the austenitic temperature range is between about 1,100° C. and about 1,300° C. A temperature below about 1,100° C. causes unsuccessful piercing and elongation due to high deformation resistance. A temperature above about 1,300° C. causes a significant decrease in hot workability and toughness due to the formation of γ-ferrite, and a decrease in yield and an unsatisfactory surface state due to significant scaling.

Piercing may be performed by any known piercing mills of a skew rolling type (Mannesmann type) or press piercing type, without limitation. The pierced raw material is subjected to elongation to form an original pipe. The elongation may be performed with any known mill, such as, for example, a mandrel mill and a plug mill without limitation. Preferably, the elongation is completed at a temperature above about 800° C.

After elongation, the original pipe is cooled to the martensitic transforming temperature (Ms temperature) to form a structure substantially composed of martensite in the original pipe. The term "structure substantially composed of martensite" means that the structure of the cooled original pipe is composed of at least about 90% by area of martensitic phase. The balance is composed of about 10% or less of austenitic phase and about 2% or less of ferritic phase. This martensitic structure facilitates formation of a recrystallized microstructure during the subsequent reheating step. If the main phase is a phase other than the martensitic phase, the recrystallized microstructure is not formed during the reheating step. As a result, toughness is not so significantly improved or the toughness exhibits noticeable anisotropy.

In the finishing rolling step, the initial rolling temperature T (° C.) is between about the $A_{c1}$ transformation point and about the $A_{c3}$ transformation point. A low initial rolling temperature T below the $A_{c1}$ transformation point results in insufficient recrystallization. Mechanical properties exhibit significant anisotropy due to remaining rolling texture. A high initial rolling temperature T above the $A_{c3}$ transformation point accelerates recrystallization after the rolling step. As a consequence, toughness is not improved due to the inhibited formation of a microstructure. Accordingly, the initial rolling temperature T (° C.) is set to the range of about the $A_{c1}$ transformation point to about the $A_{c3}$ transformation point.

Preferably, in the finishing rolling step, the reduction in area R is in the range of about 10% to about 90%, and the initial rolling temperature T and the reduction in area R satisfies relationship (1):

$$800 \leqq T-0.625R \leqq 850 \quad (1)$$

wherein the reduction in area R (%) is the ratio of a decrement by rolling to the sectional area before rolling:

Reduction in area $R$ =

[{(sectional area before rolling) − (sectional area after rolling)}/

(sectional area before rolling)]$H100$

At a reduction in area R of less than about 10%, strain generated during the rolling is small. The formation of a microstructure during the rolling is inhibited. Thus, the resulting pipe does not exhibit desired strength and toughness. At a reduction rate in area R exceeding about 90%, anisotropy is noticeable because of elongation of the structure. Accordingly, the reduction in area R during the finishing rolling step is in the range of about 10% to about 90% and more preferably about 30% to about 70%.

In addition, the initial rolling temperature T is preferably controlled according to the reduction in area R so that these two parameters satisfy relationship (1) in the finishing rolling step of the invention.

FIG. 1 is a graph showing the effects of the reduction in area R and the initial rolling temperature T in finishing rolling on the toughness of a martensitic stainless steel seamless pipe.

In region C, the initial rolling temperature T and the reduction in area R satisfy relationship (1) and the initial rolling temperature T lies between the $A_{c1}$ transformation point and the $A_{c3}$ transformation point. In region C, both the absorbed energy $(E_{-40})_L$ per unit area of the longitudinal direction (L direction) and the absorbed energy $(E_{-40})_C$ per unit area of the circumferential direction (C direction) are about 180 J/cm$^2$ or more, and the ratio $(E_{-40})_C/(E_{-40})_L$ is about 0.80 or more. Accordingly, the pipe exhibits high absorbed energy per unit area indicating high toughness and reduced anisotropy in toughness. In regions A and B wherein T−0.625R<800, the absorbed energy per unit area in the C direction decreases to less than about 180 J/cm$^2$ and the ratio $(E_{-40})_C/(E_{-40})_L$ decreases to less than about 0.80. This indicates large anisotropy. In region B in which the initial rolling temperature T is higher than the $A_{c1}$ transformation point, however, the absorbed energy per unit area in the C direction is about 90 J/cm$^2$ or more, which is a sufficiently satisfactory level in practice. In regions D and E wherein 850<T−0.625R, the absorbed energy per unit area in the L direction and the absorbed energy per unit area in the C direction decrease to less than about 180 J/cm$^2$. However, in region D in which the initial rolling temperature T is lower than the $A_{c3}$ transformation point, the absorbed energy per unit area in the L direction and the absorbed energy per unit area in the D direction are about 90 J/cm$^2$ or more, which is a sufficiently satisfactory level in practice. In conclusion, in ranges in which the initial rolling temperature T lies between the $A_{c1}$ transformation point and the $A_{c3}$ transformation point, the absorbed energy per unit area in the L direction and the absorbed energy per unit area in the D direction are about 90 J/cm$^2$ or more, which indicates sufficiently high toughness in practice.

Preferably, after the finishing rolling satisfying relationship (1), the pipe is cooled in air or cooled at a cooling rate that is larger than that of air cooling. During the subsequent tempering, a martensitic microstructure having low anisotropy is formed. As a result, the processed pipe (final pipe product) has high mechanical strength and small anisotropy.

Preferably, the finishing rolling step is performed using a tandem mill, for example, a hot stretching reducing mill or a sizing mill.

EXAMPLES

Each of martensitic stainless steel molten metals having a composition shown in Table 1 was prepared in a converter and cast into a slab by a continuous casting process. The slab was rolled to form a billet (material for an original pipe). The billet was subjected to piercing using a Mannesmann-type piercing mill and elongation using a mandrel mill to form an original pipe as shown in Table 2. After elongation, the original pipe was cooled to a temperature below the Ms point so that the composition of the pipe was substantially composed of a martensitic structure. A test piece was prepared from a part of the original pipe and the structure was observed with an optical microscope. In comparative examples, original pipes were reheated immediately after elongation, without cooling to the temperature below the Ms point.

Each original pipe was reheated to a temperature shown in Table 2 and subjected to finishing rolling under conditions shown in Table 2 using a hot stretching reducing mill to form a pipe product having a size shown in Table 2. Next, the pipe was cooled in air and tempered at a temperature shown in Table 2.

Test pieces were prepared along the longitudinal direction (L direction) of each pipe product, and the yield strength YS and tensile strength TS in the L direction were measured according to ASTM A370. The absorbed energy $E_{-40}$ per unit area at −40° C. was measured by a Charpy impact test in the circumferential direction (C direction) and the L direction according to ASTM A370. Each test piece had a thickness of 5 mm (sub size), and both ends along the C direction of the test piece for the C direction test were corrected. The ratio $(E_{-40})_C/(E_{-40})_L$ of the absorbed energy in the C direction to the L direction was calculated. These results are shown in Table 3.

Each pipe according to the invention had a high yield strength of 550 MPa or more and a high absorbed energy per unit area in the L direction $(E_{-40})_L$ of 180 J/cm$^2$ or more. The ratio $(E_{-40})_C/(E_{-40})_L$ of the absorbed energy in the C direction to the L direction was at least 0.80. Accordingly, each pipe according to invention exhibits high toughness and low anisotropy of toughness compared with a conventional example (Pipe 8) and comparative examples. Each pipe in the comparative examples exhibited low toughness in the L direction or in the C direction and high anisotropy indicated by a low ratio $(E_{-40})_C/(E_{-40})_L$ of less than 0.80.

TABLE 1

| | Composition (mass percent) | | | | | | | | | | | | |
|---|---|---|---|---|---|---|---|---|---|---|---|---|---|
| Steel | C | Si | Mn | P | S | Al | Cr | Ni, Mo, Cu | N, Nb, Ti, V | REM, Ca | $A_{c1}$ ° C. | $A_{c3}$ ° C. | Ms ° C. |
| A | 0.20 | 0.26 | 0.44 | 0.017 | 0.002 | 0.001 | 13.0 | Ni: 0.14 | N: 0.03 | — | 810 | 920 | 380 |
| B | 0.19 | 0.35 | 0.65 | 0.019 | 0.001 | 0.023 | 12.8 | Ni: 0.01 | N: 0.02, V: 0.05 | — | 810 | 940 | 370 |
| C | 0.20 | 0.24 | 0.76 | 0.013 | 0.001 | 0.002 | 13.0 | Ni: 0.05 | N: 0.02, Nb: 0.03, V: 0.03 | — | 820 | 940 | 370 |
| D | 0.03 | 0.15 | 0.50 | 0.014 | 0.001 | 0.002 | 13.1 | Ni: 4.0, Mo: 1.0 | N: 0.05, Nb: 0.02 | Ca: 0.0012 | 650 | 855 | 220 |

TABLE 2

| | | Original pipe production step | | | | | Finishing rolling step | | | | | | | | |
|---|---|---|---|---|---|---|---|---|---|---|---|---|---|---|---|
| | | Heating | Pipe Cooling | Struc- | Pipe size | | Re- | Initial Finishing | Re-duction | | Pipe size | | | Tem- | Re- |
| Pipe | Steel | temp. of billet | Final temp. | ture *1 | OD *2 (mm) | T *3 (mm) | heating temp. | Rolling Temp. | Rate (%) | P *4 | OD *2 (mm) | T *3 (mm) | Cooling | pering Temp. | marks *5 |
| 1 | A | 1,250° C. | 50° C. | M + A | 172 | 7.2 | 850° C. | 830° C. | 61.1 | 792 | 73.0 | 7.0 | Air | 720° C. | PI |
| 2 | A | 1,250° C. | 50° C. | M + A | 172 | 7.2 | 870° C. | 850° C. | 61.1 | 812 | 73.0 | 7.0 | Air | 700° C. | PI |
| 3 | A | 1,250° C. | 50° C. | M + A | 172 | 7.2 | 890° C. | 870° C. | 61.1 | 832 | 73.0 | 7.0 | Air | 700° C. | PI |
| 4 | A | 1,250° C. | 50° C. | M + A | 172 | 7.2 | 920° C. | 900° C. | 61.1 | 862 | 73.0 | 7.0 | Air | 700° C. | PI |
| 5 | A | 1,250° C. | 50° C. | M + A | 172 | 7.2 | 970° C. | 950° C. | 61.1 | 912 | 73.0 | 7.0 | Air | 700° C. | CE |
| 6 | A | 1,330° C. | 50° C. | M + A + F *6 | 172 | 7.2 | 870° C. | 850° C. | 61.1 | 812 | 73.0 | 7.0 | Air | 720° C. | CE |
| 7 | A | 1,250° C. | 400° C. | A | 172 | 7.2 | 870° C. | 850° C. | 61.1 | 812 | 73.0 | 7.0 | Air | 720° C. | CE |
| 8 | A | 1,250° C. | 750° C. | A | 172 | 7.2 | 970° C. | 950° C. | 61.1 | 912 | 73.0 | 7.0 | Air | 720° C. | TE |
| 9 | A | 1,250° C. | 50° C. | M + A | 110 | 10.0 | 850° C. | 830° C. | 80.5 | 780 | 33.2 | 7.6 | Air | 720° C. | PI |
| 10 | A | 1,250° C. | 50° C. | M + A | 110 | 10.0 | 890° C. | 870° C. | 80.5 | 820 | 33.2 | 7.6 | Air | 700° C. | PI |
| 11 | B | 1,250° C. | 50° C. | M + A | 172 | 7.0 | 820° C. | 800° C. | 35.8 | 778 | 114.3 | 6.9 | Air | 700° C. | CE |
| 12 | B | 1,250° C. | 50° C. | M + A | 172 | 7.0 | 870° C. | 850° C. | 35.8 | 828 | 114.3 | 6.9 | Air | 700° C. | PI |
| 13 | B | 1,250° C. | 50° C. | M + A | 172 | 7.0 | 910° C. | 890° C. | 35.8 | 868 | 114.3 | 6.9 | Air | 700° C. | PI |
| 14 | B | 1,250° C. | 50° C. | M + A | 192 | 8.9 | 800° C. | 780° C. | 13.0 | 772 | 168.2 | 8.9 | Air | 720° C. | CE |
| 15 | B | 1,250° C. | 50° C. | M + A | 192 | 8.9 | 840° C. | 820° C. | 13.0 | 812 | 168.2 | 8.9 | Air | 720° C. | PI |
| 16 | B | 1,250° C. | 50° C. | M + A | 192 | 8.9 | 870° C. | 850° C. | 13.0 | 842 | 168.2 | 8.9 | Air | 720° C. | PI |
| 17 | B | 1,250° C. | 50° C. | M + A | 192 | 8.9 | 890° C. | 870° C. | 13.0 | 862 | 168.2 | 8.9 | Air | 700° C. | PI |
| 18 | D | 1,250° C. | 50° C. | M + A | 192 | 8.9 | 840° C. | 820° C. | 13.0 | 812 | 168.2 | 8.9 | Air | 720° C. | PI |
| 19 | D | 1,250° C. | 50° C. | M + A | 192 | 8.9 | 650° C. | 630° C. | 13.0 | 622 | 168.2 | 8.9 | Air | 640° C. | CE |
| 20 | A | 1,250° C. | 50° C. | M + A | 110 | 10.0 | 970° C. | 950° C. | 80.5 | 900 | 33.2 | 7.6 | Air | 700° C. | CE |
| 21 | A | 1,250° C. | 50° C. | M + A | 172 | 7.2 | 770° C. | 750° C. | 61.1 | 712 | 73.0 | 7.0 | Air | 720° C. | CE |
| 22 | B | 1,250° C. | 50° C. | M + A | 172 | 7.0 | 770° C. | 750° C. | 35.8 | 728 | 114.3 | 6.9 | Air | 720° C. | CE |
| 23 | B | 1,250° C. | 50° C. | M + A | 172 | 7.0 | 970° C. | 950° C. | 35.8 | 928 | 114.3 | 6.9 | Air | 700° C. | CE |
| 24 | B | 1,250° C. | 50° C. | M + A | 192 | 8.9 | 770° C. | 750° C. | 13.0 | 742 | 168.2 | 8.9 | Air | 720° C. | CE |
| 25 | C | 1,250° C. | 50° C. | M + A | 172 | 7.2 | 890° C. | 870° C. | 61.1 | 832 | 73.0 | 7.0 | Air | 700° C. | PI |

*1 Crystal structure of the composition of original pipe, M = martensite, A = austenite, F = ferrite
*2 OD = outer diameter,
*3 T = thickness TABLE 2-continued

| | | Original pipe production step | | | | | Finishing rolling step | | | | | | | | |
|---|---|---|---|---|---|---|---|---|---|---|---|---|---|---|---|
| | | Heating | Pipe Cooling | Struc- | Pipe size | | Re- | Initial Finishing | Re-duction | | Pipe size | | | Tem- | Re- |
| Pipe | Steel | temp. of billet | Final temp. | ture *1 | OD *2 (mm) | T *3 (mm) | heating temp. | Rolling Temp. | Rate (%) | P *4 | OD *2 (mm) | T *3 (mm) | Cooling | pering Temp. | marks *5 |

*4 parameter (center in relationship (1) = T − 0.625R)
*5 PI = present invention, CE = comparative example, TE = conventional example
*6 F content = 4%

TABLE 3

| | Tensile Properties | | Toughness Absorbed energy (J/mm$^2$) | | | |
|---|---|---|---|---|---|---|
| Pipe | YS (MPa) | TS (MPa) | L direction | C direction | Ratio C/L | Remarks |
| 1 | 601 | 769 | 241 | 116 | 0.48 | Present Invention |
| 2 | 593 | 763 | 230 | 205 | 0.89 | Present Invention |
| 3 | 623 | 783 | 208 | 195 | 0.94 | Present Invention |
| 4 | 599 | 769 | 128 | 106 | 0.83 | Present Invention |
| 5 | 587 | 760 | 96 | 89 | 0.93 | Comparative example |
| 6 | 573 | 764 | 73 | 65 | 0.89 | Comparative example |
| 7 | 600 | 774 | 221 | 96 | 0.43 | Comparative example |
| 8 | 572 | 760 | 78 | 72 | 0.92 | Conventional Example |
| 9 | 621 | 790 | 249 | 108 | 0.43 | Present Invention |
| 10 | 618 | 792 | 219 | 198 | 0.90 | Present Invention |
| 11 | 605 | 773 | 229 | 85 | 0.37 | Comparative example |
| 12 | 598 | 767 | 208 | 185 | 0.89 | Present Invention |
| 13 | 620 | 798 | 121 | 109 | 0.90 | Present Invention |
| 14 | 612 | 779 | 227 | 90 | 0.40 | Comparative example |
| 15 | 589 | 762 | 210 | 183 | 0.87 | Present Invention |
| 16 | 608 | 785 | 196 | 186 | 0.95 | Present Invention |
| 17 | 592 | 763 | 108 | 93 | 0.86 | Present Invention |
| 18 | 639 | 795 | 251 | 221 | 0.88 | Present Invention |
| 19 | 702 | 873 | 248 | 85 | 0.34 | Comparative example |
| 20 | 584 | 775 | 79 | 75 | 0.95 | Comparative example |
| 21 | 612 | 793 | 203 | 76 | 0.37 | Comparative example |
| 22 | 599 | 753 | 189 | 82 | 0.43 | Comparative example |
| 23 | 604 | 755 | 86 | 82 | 0.95 | Comparative example |
| 24 | 586 | 754 | 221 | 75 | 0.34 | Comparative example |
| 25 | 723 | 901 | 219 | 196 | 0.89 | Present Invention |

What is claimed is:

1. A method for making a high-strength high-toughness martensitic stainless steel seamless pipe comprising:

heating a martensitic stainless steel raw material to an austenitic range;

piercing and elongating the raw material to form an original pipe;

cooling the original pipe to form a structure substantially composed of martensite in the original pipe;

reheating the original pipe to a temperature in a dual-phase range between the $A_{c1}$ transformation point and the $A_{c3}$ transformation point directly after cooling the original pipe to form the structure substantially composed of martensite;

finish-rolling the original pipe at an initial rolling temperature T (° C.) between the $A_{c1}$ transformation point and the $A_{c3}$ transformation point;

cooling the original pipe to form a processed pipe having a predetermined size; and tempering the processed pipe at a temperature below the $A_{c1}$ transformation point.

2. The method according to claim 1, wherein a reduction in area R during finishing rolling is in the range of about 10% to about 90%, and the initial rolling temperature T and the reduction in area R satisfy the relationship: $800 \leqq T - 0.625R \leqq 850$.

3. The method of claim 1, wherein the raw material contains about 0.005% by weight to about 0.30% C, about 0.10% to about 1.00% Si, about 0.05% to about 2.00% Mn, about 0.03% or less of P, about 0.005% or less of S, about 10.0% to about 15.0% Cr, about 0.001% to about 0.05% Al; and the balance Fe and incidental impurities.

4. The method of claim 3, wherein the raw material further contains about 7.0% or less of Ni, about 3.0% or less of Mo, and about 3.0% or less of Cu; at least one element of about 0.2% or less of Nb, about 0.2% or less of V, about 0.3% or less of Ti, about 0.2% or less of Zr, about 0.0005% to about 0.01% B, and about 0.07% or less of N; about 0.0005% to about 0.01% Ca and about 0.0005% to about 0.01% REM (rare earth metals).

5. The method of claim 1, wherein the austenitic temperature is between about 1100° C. and about 1300° C.

6. The method of claim 1, wherein elongating the raw material is performed at a temperature of above about 800° C.

7. The method of claim 1, wherein the $A_{C1}$ transformation point is at about 815° C.

8. The method of claim 1, wherein the $A_{C3}$ transformation point is at about 920° C.

9. The method of claim 1, wherein a reduction in area R during finish rolling is between about 30% and about 70%.

10. The method of claim 1, wherein the steel has an absorbed energy $(E_{-40})_L$ per unit area of a longitudinal direction (L direction) and an absorbed energy $(E_{-40})_C$ per unit area of a circumferential direction (C direction) of about 180 J/cm$^2$ or more.

11. The method of claim 1, wherein the steel has an absorbed energy $(E_{-40})_L$ per unit area of a longitudinal direction (L direction) and an adsorbed energy $(E_{-40})_L$ per unit area of a circumferential direction (C direction) of about 90 J/cm$^2$ or more.

12. A method for making a high-strength high-toughness martensitic stainless steel seamless pipe comprising:

heating a martensitic stainless steel raw material to an austenitic range;

piercing and elongating the raw material to form an original pipe;

cooling the original pipe to form a structure substantially composed of martensite in the original pipe;

reheating the original pipe to a temperature in a dual-phase range between the $A_{c1}$ transformation point and the $A_{c3}$ transformation point directly after cooling the original pipe to form the structure substantially composed of martensite;

finish-rolling the original pipe at an initial rolling temperature T (° C.) between the $A_{c1}$ transformation point and the $A_{c3}$ transformation point;

cooling the original pipe to form a processed pipe having a predetermined size; and tempering the processed pipe at a temperature below the $A_{c1}$ transformation point such that the steel has an absorbed energy $(E_{-40})_L$ per unit area of a longitudinal direction (L direction) and an absorbed energy $(E_{-40})_C$ per unit area of a circumferential direction (C direction) of about 180 J/cm$^2$ or more, and a ratio $(E_{-40})_C/(E_{-40})_L$ of about 8.0 or more.

13. A method for making a high-strength high-toughness martensitic stainless steel seamless pipe consisting essentially of:

heating a martensitic stainless steel raw material to an austenitic range;

piercing and elongating the raw material to form an original pipe:

cooling the original pipe to form a structure substantially composed of martensite in the original pipe;

reheating the original pipe to a temperature in a dual-phase range between the $A_{c1}$ transformation point and the $A_{c3}$ transformation point;

finish-rolling the original pipe at an initial rolling temperature T (° C.) between the $A_{c1}$ transformation point and the $A_{c3}$ transformation point;

cooling the original pipe to form a processed pipe having a predetermined size; and tempering the processed pipe at a temperature below the $A_{c1}$ transformation point.

* * * * *